US006682214B1

(12) United States Patent
Vivek et al.

(10) Patent No.: US 6,682,214 B1
(45) Date of Patent: Jan. 27, 2004

(54) ACOUSTIC WAVE MICROMIXER USING FRESNEL ANNULAR SECTOR ACTUATORS

(75) Inventors: Vibhu Vivek, Santa Clara, CA (US); Eun Sok Kim, Torrance, CA (US); Yi Zeng, Fremont, CA (US)

(73) Assignee: University of Hawaii, Honolulu, HI (US)

( * ) Notice: Subject to any disclaimer, the term of this patent is extended or adjusted under 35 U.S.C. 154(b) by 41 days.

(21) Appl. No.: 10/089,042

(22) PCT Filed: Sep. 21, 2000

(86) PCT No.: PCT/US00/25961

§ 371 (c)(1),
(2), (4) Date: Mar. 21, 2002

(87) PCT Pub. No.: WO01/21291

PCT Pub. Date: Mar. 29, 2001

Related U.S. Application Data

(60) Provisional application No. 60/155,180, filed on Sep. 21, 1999.

(51) Int. Cl.[7] ..... B01F 13/00; B01F 11/00

(52) U.S. Cl. ..... 366/108; 366/116; 366/127; 366/341; 366/DIG. 4

(58) Field of Search ..... 366/127, 116, 366/108, 341, DIG. 4

(56) References Cited

U.S. PATENT DOCUMENTS 2,950,725 A * 8/1960 Jacke et al. ..... 366/108
3,066,686 A * 12/1962 O'Neill ..... 366/108
4,395,652 A 7/1983 Nakanishi et al.
4,467,237 A * 8/1984 Piaget et al. ..... 310/334
4,586,512 A * 5/1986 Do-huu et al. ..... 600/447
4,829,209 A 5/1989 Kawasaki et al.
4,888,861 A 12/1989 Day
5,484,573 A * 1/1996 Berger et al. ..... 366/116
5,794,023 A * 8/1998 Hobbs et al. ..... 359/565
5,890,802 A * 4/1999 Evensen et al. ..... 366/127
6,010,316 A * 1/2000 Haller et al. ..... 417/322
6,081,064 A * 6/2000 Pfeiffer et al. ..... 310/334
6,244,738 B1 * 6/2001 Yasuda et al. ..... 366/114
6,361,747 B1 * 3/2002 Dion et al. ..... 366/127
6,568,052 B1 * 5/2003 Rife et al. ..... 366/127

* cited by examiner

*Primary Examiner*—Tony G. Soohoo
(74) *Attorney, Agent, or Firm*—Dorsey & Whitney LLP

(57) ABSTRACT

A Fresnel Annular Sector Actuator (FASA) for micromixing of fluids, utilizes a self-focusing acoustic wave transducer which focuses acoustic waves through constructive wave interference. In the transducer, RF power is applied between the electrodes (sandwiching a piezoelectric film) with its frequency preferably corresponding to the thickness mode resonance of the piezoelectric film. Strong acoustic waves are generated over the electrode area, and interfere with each other as they propagate in the fluid. By proper design of the electrodes, and forming various combinations of the electrodes, wave focusing can be achieved. The mixing can be further enhanced by providing selective actuation and sequencing of the different segments by an RF signal source.

20 Claims, 6 Drawing Sheets

ACOUSTIC WAVE MICROMIXER USING FRESNEL ANNULAR SECTOR ACTUATORS

CROSS-REFERENCE TO A RELATED APPLICATION

The present application is based on a provisional application Serial No. 60/155,180 filed Sep. 21, 1999, and entitled DESIGNS OF ACOUSTIC WAVE MICRO-MIXER SING FASA (FRESNEL ANNULAR SECTOR ACTUATOR) FOR INTEGRATION IN LARGE SCALE FLUIDIC MICRO-ELECTROMECHANICAL SYSTEMS; this provisional application is-incorporated herein by reference, and the priority of the provisional application is claimed herein.

FIELD OF THE INVENTION

The present invention relates to the design of a MEMS based micromixer and more specifically with the use of acoustic energy to mix very small quantities of fluid.

BACKGROUND OF THE INVENTION

Microfluidic processing systems need to transport and/or mix two or more kinds of fluids of accurately controlled amount in reasonable period of time. Since many microfluidic devices are fabricated in planar lithographic environment, most of the macroscopic approaches for fluid mixing like turbulence and mechanical actuation are inapplicable at microscopic levels. and using heat for mixing is not desirable for mixing temperature sensitive fluids (such as a DNA sample). A mechanical plunger with a push-pull operational mode is effective for mixing fluids, but only as long as the fluid height is greater than 500 $\mu$m while the fluid-surface area is around $mm^2$–$cm^2$ range.

It has been reported that focused acoustic waves (generated by annular rings of half-wave-band sources made of piezoelectric thin film and electrodes sitting on a diaphragm) are effective in generating fluidic motion. But when the fluid height is reduced to 100 $\mu$m range while the fluid-surface area remains in $mm^2$–$cm^2$ range, there must be much stronger lateral acoustic pressure to push and pull the fluid for mixing. Thus, the problem of successfully, selectively mixing fluid in very small amounts remains.

SUMMARY OF THE INVENTION

It is an object of the invention to provide method and apparatus for micromixing of very small fluid amounts.

It is a related object to the invention to provide micromixing by utilizing acoustic wave generation and an acoustic transducer.

In summary, the present invention utilizes a Fresnel Annular Sector Actuator (FASA) for micromixing of fluids. The FASA is based on a self-focusing acoustic wave transducer which focuses acoustic waves through constructive wave interference. In the transducer, RF power is applied between the electrodes (sandwiching a piezoelectric film) with its frequency preferably corresponding to the thickness mode resonance of the piezoelectric film. Strong acoustic waves are generated over the electrode area, and interfere with each other as they propagate in the fluid. By proper design of the electrodes, and forming various combinations of the electrodes, wave. focusing can-be achieved. The mixing can be further enhanced by providing selective actuation of the different segments.

More specifically, it has been observed that when a complete annular ring is broken into segments at different angles, there are proportionate changes in the vertical and lateral acoustic potential profile. With the angle of the sector profile getting smaller, the gradient of the lateral acoustic potential becomes greater. At the same time, the vertical potential profile becomes more distributed. The present invention, while useful with sector profiles of various angles less than a complete ring, is optimized in the region of around a 90° segment. The electrode pattern of this transducer has a high lateral acoustic potential across the focal plane of the device. The pattern is preferably realized by patterning aluminum on both sides of a piezoelectric substrate. When RF power is applied between the electrodes which frequencies correspond to the thickness mode resonance piezoelectric substrate, acoustic waves are generated.

More specifically, the electrode patterns are designed to produce constructive wave interference by utilizing a RF signal source. The RF can also be modulated using a high speed switch, or by a pulse generator. The modulated RF signal is then amplified and fed in the sector device. This causes a strong lateral force in the liquid at the focal plane. By energizing different designs of using a plurality of FASA elements, including a single overlap design which has segmented top and bottom electrodes such that the overlap area under actuation at any given time is 90°; or a four sector corner design providing for isolated sectors placed away from the center and four cornered sectors to eliminate dead zone at the comers, and a six sector corner design where additional segments are added in the middle for more area coverage. By periodic actuation using appropriate electronic controls of these sectors strong fluid flow in different direction is generated. By proper control in the actuation, a random or controlled mixing is achieved. This is realized by time phasing the sectors. Finally, by varying the time frequency of the sectors in accordance with different fluid characteristics, a wide range of fluid mixing can be accomplished.

Other features and advantages of the present invention will become apparent to a person of skill in the art who studies the following description of the preferred and exemplary embodiments, given in association with the following figures.

DETAILED DESCRIPTION OF THE PREFERRED EMBODIMENTS

Figure 1:
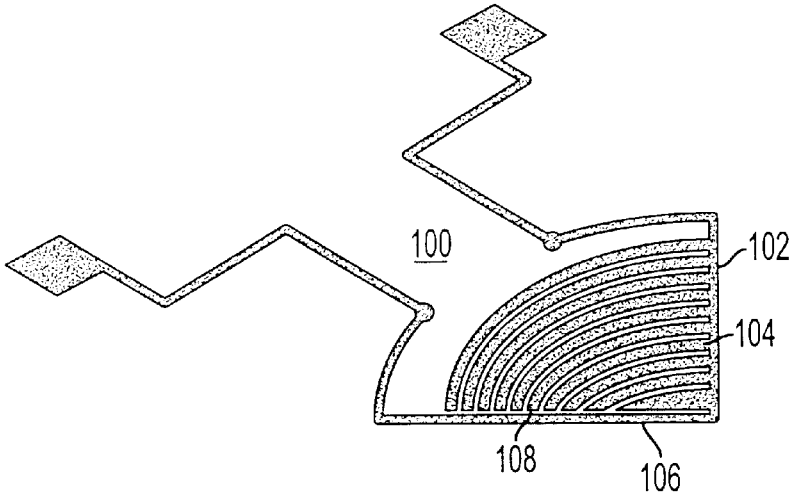
FIG. 1 illustrates a Fresnel Annular Sector Actuator (FASA) transducer: the basic cell.

Microfluidic processing systems need to transport and/or mix two or more kinds of fluids of accurately controlled amount in reasonable period of time. Since many microfluidic devices are fabricated in planar lithographic environment, most of the macroscopic approaches for fluid mixing including turbulence, three dimensional flow and mechanical actuation are inapplicable. Our design accomplishes micromixing efficiently. The basic element of the mixer is the Fresnel Annular Sector Actuator (FASA). It has been observed that when a complete annular ring is broken into segments of different angles, there are proportionate changes in the vertical and lateral acoustic potential profile. With the angle of the sector getting smaller, the gradient of the lateral acoustic potential becomes better; at the same time, the vertical potential profile becomes more distributed. Thus while the FASA of this invention as shown in FIG. 1 is effective with sectors of many angles, an optimum sector is 90°. The electrode pattern (FIG. 1) of this transducer is designed so as to have a high lateral acoustic potential across the focal plane of the device. This. pattern is realized. by patterning aluminum on both sides of a piezoelectric substrate (PZT-5H). When RF power is applied between the electrodes which frequencies corresponding to the thickness mode resonance of the piezoelectric substrate, acoustic waves are generated. The results of simulation on this design shows the vertical and lateral particle displacement when considering reflection from water-air and water-PZT interface. The simulation results are in accordance with the proposed design. It should be noted that although a circular design is described, sectors of other shapes such as elliptical, parabolic and the like may be equally useful and in fact, in certain instances, be more effective.

Spherical lenses or Fresnel acoustic lenses can focus acoustic wave. Spherical lens is based on the refraction at the boundary between an isotropic sold and a liquid, while Fresnel lens relies on interference among the waves. When half-wave-band sources based on Fresnel lens are segmented, lateral focusing is accomplished, and thus a so called Fresnel Annular Sector Actuator (FASA) is provided which acts as the basic cell for producing strong lateral fluidic motion inside a liquid.

The operating principle of FASA is based on the self-focusing acoustic-wave transducer, which focuses acoustic waves (generated by annular rings of half-wave-band sources made of piezoelectric thin film and electrodes sitting on a diaphragm) through constructive wave interference. In the transducer, when RF power is applied between the electrodes (sandwiching the piezoelectric film) with its frequency corresponding to the thickness mode resonance of the piezoelectric film, strong acoustic waves are generated over the electrode area, and interfere with each other as they propagate in the fluid. With proper design of the annular electrodes, wave focusing is achieved without any acoustic lens.

When the complete annular rings are broken into segments of different angles, there are proportionate changes in the vertical and lateral acoustic-potential profiles. With the angle of sector getting smaller, the gradient of the lateral acoustic potential becomes larger, while the vertical potential profile becomes more distributed. Using this concept a 90° FASA 100 on a PZT substrate has been designed as shown in FIG. 1. The electrode patterns for the top and bottom electrodes are designed to produce a very high lateral acoustic-potential gradient, and comprise a plurality of concentric substantially equally spaced conductive traces on the upper and lower surfaces 104 of substrate 108. The control signals are applied to terminals 110, 112, respectively, to drive the FASA in a manner to be described below.

Spherical lenses or Fresnel acoustic lenses can focus acoustic waves. Spherical lens is based on the refraction at the boundary between an isotropic solid and a liquid, while Fresnel lens relies on interference among the waves. When half-wave-band sources based on Fresnel lens are segmented, lateral focusing is accomplished, and thus a so-called Fresnel Annular Sector Actuator (FASA) is provided which acts as the basic cell for producing strong lateral fluidic motion inside a liquid.

Figure 2:
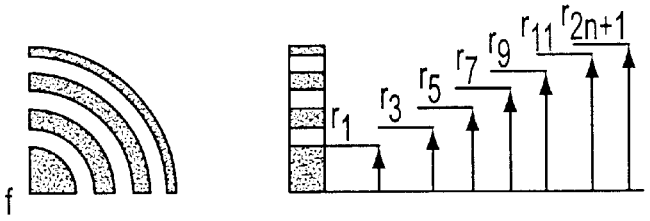
FIG. 2 illustrates the electrode pattern for a segmented Fresnel Annular Ring to cause lateral acoustic focusing.

FIG. 2 shows a FASA transducer with 90° segments of annular sources which is useful in the following analysis of FASA operation. The electrode pattern of FIG. 2 is designed to establish lateral acoustic focusing. It should be noted that the 90° sector is only a preferred embodiment; most other segment angles are potentially useful, depending on the objectives of the implementation, as are other, non-circular shapes. The acoustic waves generated by the successive annular sources are designed to arrive at the focal point f with finite delays (equal to the multiples of the wavelength) by ensuring that the radii $r_n$ satisfy the following condition:

$$r_n = \sqrt{n\lambda_w\left(f + \frac{n\lambda_w}{2}\right)} \tag{1}$$

where n=1,3,5 . . . (2n+1) and $\lambda_w$ is the wavelength of the acoustic wave in the liquid. The acoustic waves are generated by all the successive sources, and arrive at the focal point in phase, resulting in constructive interference. These sources are referred to as half-wave-band sources. Once the annular rings 102, 104 are segmented they cause lateral focusing in addition to axial focusing.

For a 90° segmented half-wave-band source generating acoustic waves inside liquid, the acoustic potential at any point in the liquid (FIG. 3) is given by $$\phi(r'', \psi'', z) = -\frac{u_o}{2\pi}\int_{\psi'=0}^{\frac{\pi}{2}}\int_{r''=0}^{a}\frac{e^{-jkR}}{R}r'\,d\psi'\,dr' \tag{2}$$

where $R=\sqrt{z^2+r'^2+r^{n2-2r'r''\cos(\phi''-\phi')}}$; k=2 π/λ;r' is the radius of the segmented annular electrode at z=0; and r" is the radius of a circle at z≠0 (i.e., inside the liquid).

The force exerted by an acoustic wave is related to the particle velocity v by $$v = -\frac{V_a}{c}T \tag{3}$$

where Va is the acoustic wave velocity and $$v = \frac{du}{dt} = -j\omega u \tag{4}$$

for a harmonic particle displacement $u=u_0e^{-jwt}$.

Once the acoustic potential is obtained using equation (2), we can calculate the relative particle displacements in the radial (r"), vertical (z) and circumferential (φ") directions at any point in the liquid over the 90° FASA transducer as follows. The relative particle displacement in the radial direction is given by $$u_{r'} = \frac{\partial}{\partial r}\phi(r'', \psi'', z)\Big|_{\psi''=const, z=const} = \frac{\partial}{\partial r''}\left(-\frac{u_o}{2\pi}\int_{\psi'=0}^{\frac{\pi}{2}}\int_{r'=0}^{a}\frac{e^{-jkR}}{R}r'\,d\psi'\,dr'\right) \tag{5}$$

$$u_{r''} = \frac{u_o}{2\pi}\int_{\psi'=0}^{\frac{\pi}{2}}\int_{r''=0}^{a}\frac{e^{-jkR}}{R^3}\Big)1 + jkR\Big)(r'' = r'\cos(\psi'' - \psi'))r'\,d\psi'\,dr' \tag{6}$$

The relative particle displacement in the vertical direction is given by $$u_z = \frac{\partial}{\partial z}\phi(r'', \psi'', z)\Big|_{\psi''=const, r''=const} = \frac{\partial}{\partial z}\left(-\frac{u_o}{2\pi}\int_{\psi'=0}^{\frac{\pi}{2}}\int_{r'=0}^{a}\frac{e^{-jkR}}{R}r'\,d\psi'\,dr'\right) \tag{7}$$

$$u_z = \frac{u_o}{2\pi}\int_{\psi'=0}^{\frac{\pi}{2}}\int_{r'=0}^{a}\frac{e^{-jkR}}{R}(1 + jkR)zr'\,d\psi'\,dr' \tag{8}$$

The relative particle displacement in the circumferential is given by $$u_{\psi''} = \frac{1}{r'}\frac{\partial}{\partial \psi''}\phi(r'', \psi'', z)\Big|_{z=const, r''=const} = \frac{\partial}{\partial \psi''}\left(-\frac{u_o}{2\pi}\int_{\psi'=0}^{\frac{\pi}{2}}\int_{r'=0}^{a}\frac{e^{-jkR}}{R}\,d\psi'\,dr'\right) \tag{9}$$

$$u_{\psi''} = \frac{u_o}{2\pi}\int_{\psi'=0}^{\frac{\pi}{2}}\int_{r'=0}^{a}\frac{e^{-jkR}}{R}(1 + jkR)r'r''\sin(\psi'' - \psi')d\psi'\,dr' \tag{10}$$

Figure 4:
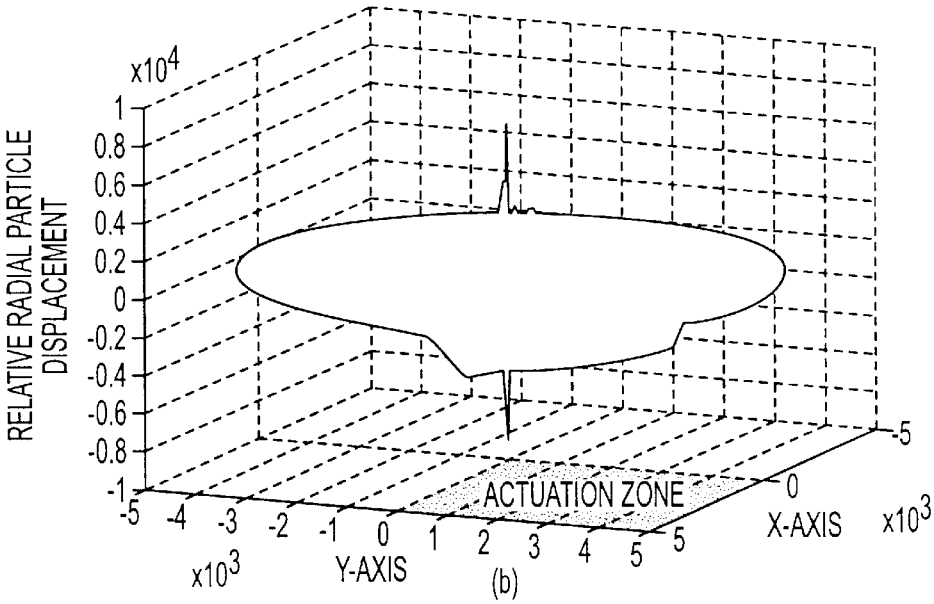
FIG. 4 illustrates simulated particle displacements along the radial r" direction at a plane 100 $\mu$m away from the 90° FASA transducer which covers a quadrant of a 5 mm radius circle, 3-D plot.
Figure 5:
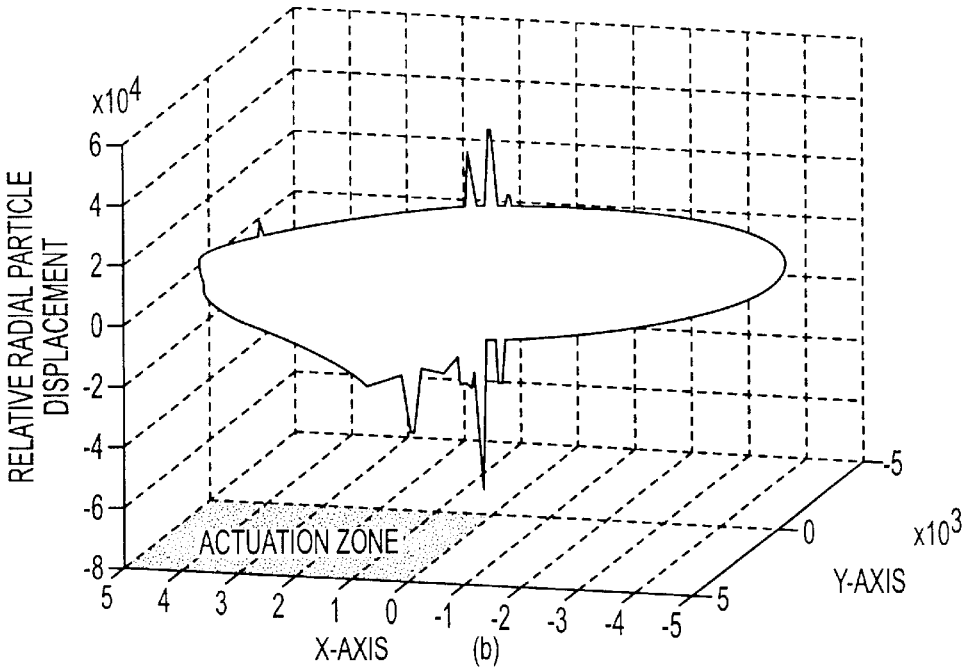
FIG. 5 illustrates simulated particle displacements along the vertical z direction at a plane 100 $\mu$m away from the 90° FASA transducer which covers a quadrant of a 5 mm radius circle, 3-D plot.
Figure 6:
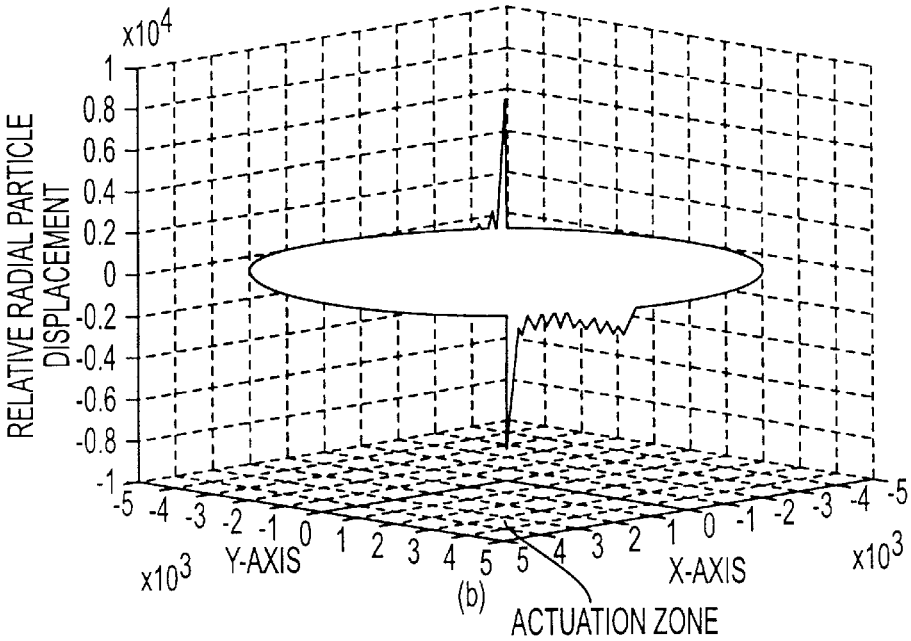
FIG. 6 illustrates simulated particle displacements along the circumferential Ψ" direction at a plane 100 $\mu$m away from the 90° FASA transducer which covers a quadrant of a 5 mm radius circle, 3-D plot.

Computer simulations were carried out for the relative particle displacement at any point in the liquid using segmented half-wave-band sources (10 segmented-annular rings) at the designed focal place of 100 μm from the 90° FASA transducer. This is shown in 3-D plots in the FIGS. 4, 5 and 6. The transducer covers a quadrant of a 5-mm radius circle (in the actuation zone). From FIG. 3, which shows the particle displacement in the radial direction the ratio of the center peak to the next side lobe is shown to be 5:1 with the center peak having a relative value of $1\times10^9$. On the other hand, FIG. 5 (which plots the particle displacement in the vertical or z-direction) shows more distributed acoustic field with the ratio of the center peak to the next side lobe being 3:1 and the center peak being only about $6\times10^8$ relative value. Comparing these two simulations, we see that for shallow water (with height being much smaller than any one dimension of a square surface area), the acoustic potential gradient is shown to be stronger in the radial direction than in the vertical direction. Also, in FIG. 6 (which shows the particle displacement in the φ-direction that is related to a rotational force), two peaks with 180° phase difference around the circular-plane center are shown. This means that at the local point the main flow is separated into two with opposite directions. These two flows create the flow pattern for an efficient micromixing.

It should be noted that the FASA can be made in different sizes depending on the application. The dimensions can be reduced to μm if desired.

Figure 7:
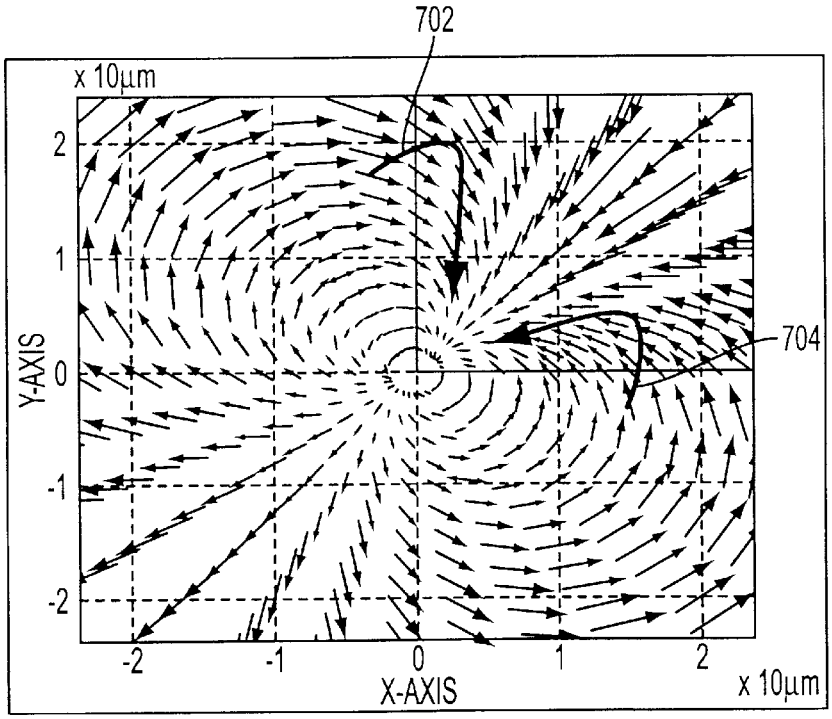
FIG. 7 illustrates a simulated vector field of particle displacements at a plane 150 $\mu$m away from the transducer.

FIG. 7 shows a simulated vector flow of particle displacement at a plane that is about 150 μm away above the 90°. FASA. From this simulation shows two loops and the directional shoot-out of the fluid at the center of the figure (i.e., the 90° corner of the 90° FASA), and consider this movement as a driving pattern. The flow pattern near the center is very strong, and dominates the fluid flow in the area.

The simulated results on the acoustic potential and particle displacements show that FASA transducer is effective for micromixing over a relatively large surface area. Particularly, the vector field flow profile of FIG. 7 clearly shows two circular loops 702, 704 at the center, which can help in liquid agitation and mixing. Using more than one FASA transducer over a given area and switching them periodically in a controlled fashion can produce even better micromixing speed over an even larger surface area. This approach of using more than one FASA transducers will allow a localized mixing over a large area.

And with switching between different sectors we can transport and mix liquid from one area to another. Another important aspect of FASA based micromixing is that since this transducer generates acoustic waves which can propagate through different elastic media like glass, silicon, etc. with proper impedance matching, non-invasive micromixing can be achieved over various media.

Therefore, design of micromixers based on the Fresnel Annular Sector Actuator (FASA) is discussed below. Three different designs (so called overlap, four-sector and six-sector) for micromixing are introduced. Fabrication steps to build the micromixer are explained. Packaging the four-sector and six-sector micromixers is discussed; and a useful driver will be described.

Using FASA transducer as the basic cell, following are three exemplary designs of micromixer using the 90° FASA transducer:

1) Overlap micromixer
2) Four-sector micromixer
3) Six-sector micromixer

Other designs are of course within the scope of the invention and may be more useful to achieve certain objectives.

Figure 8A:
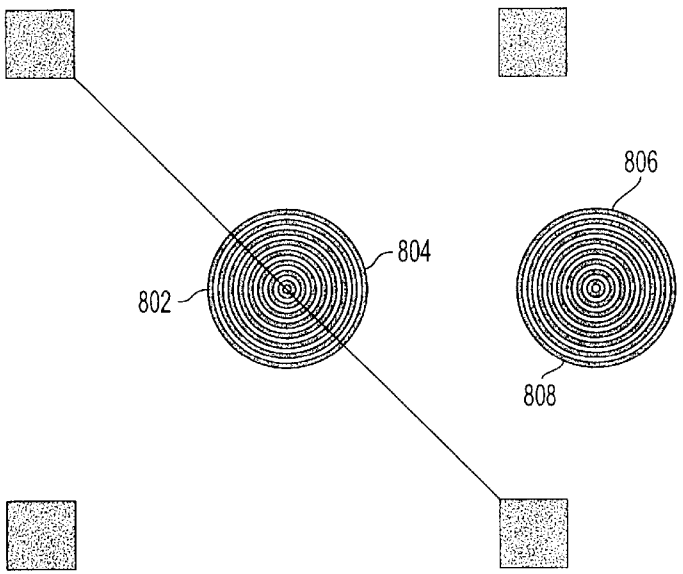
FIG. 8A illustrates an overlap pattern design.
Figure 8B:
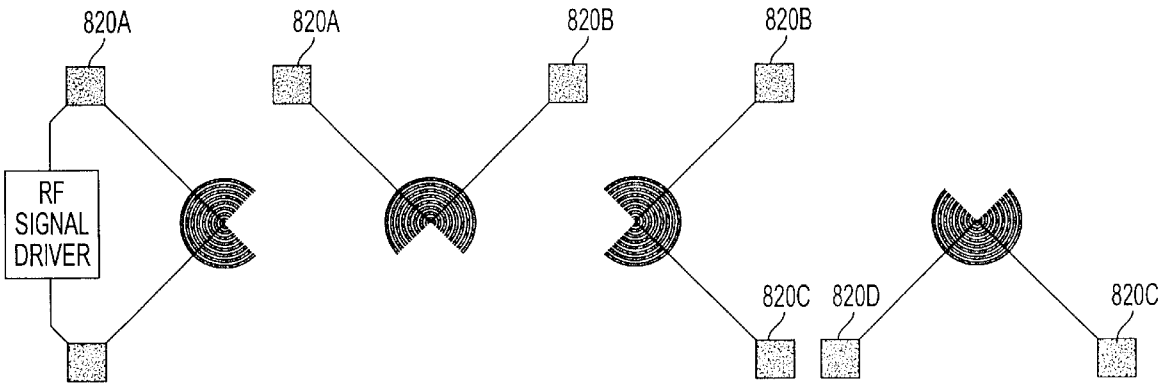
FIG. 8B illustrates switching schematics of the overlap mixer device.

The overlap design shown in FIG. 8 comprises half-circle annular rings for the half-wave-band sources patterned on the top and bottom sides of a piezoelectric substrate so that the electrodes segmented into two half-segments on the top 802, 804 and bottom 806, 808 are orthogonal to each other (See illustration of relative positioning in FIG. 8A). The RF signal driver 810 is coupled to the top segment and its adjacent bottom electrode such that the overlap area under actuation at any given time makes an angle of 90°, thus making a total of 4 possible overlaps as shown in FIG. 8B. The switching schematic is shown in FIG. 8B; typically the driver 810 is connected to two adjacent electrodes of the electrode 820A,B,C,D; it is apparent from FIG. 8A that alternate electrodes will be connected to the top and bottom segment halves.

With consecutive sequencing of the overlaps a rotation cycle is formed. Thus the fluid can have a local mixing within the sector according to the flow profile shown in FIG. 3 and along with it, the fluid can spread from one section to another.

Figure 9:
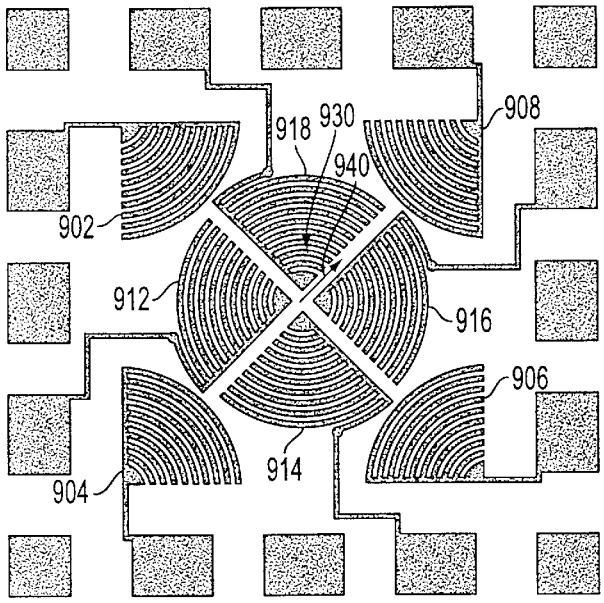
FIG. 9 illustrates a four-sector cornered design.

A four-sector design is shown in FIG. 9. In this, there are four isolated sectors 912, 914, 916, 918 spaced around the center with their vertex pointed at the center along with 4-corner sectors 902,904,906,908 each having a vertex pointed at the corner and selectively driven by a single, associated electrode. Each of the sectors can be independently actuated from an associated electrode which is coupled to every line segment of the actuator. The corner sectors eliminate dead-zone at the corners. The predicted fluid flows can also be seen, with the arrow showing the fluid flowing in the direction of actuation in each sector, while the arrow 940 shows the re-circulating fluid between each two adjacent sectors. With a proper switching scheme we can ensure fluid flow throughout the chip area can be ensured.

Figure 10:
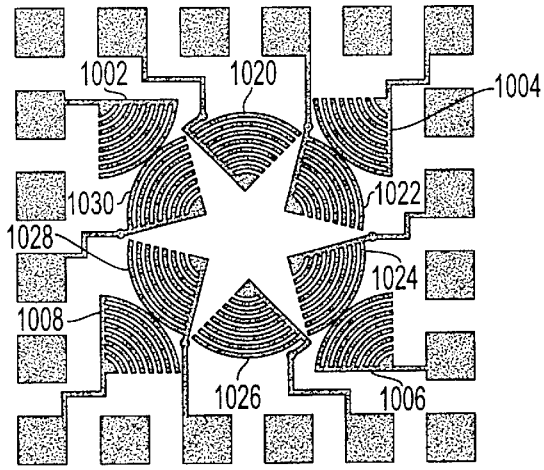
FIG. 10 illustrates a six-sector cornered pattern design.

The six-sector design is shown in FIG. 10. In addition to the four corner sectors 1002, 1004, 1006, 1008 in the previous design of FIG. 9, there are six sectors 1020–1030 placed around the center with their vertexes pointed at the center; this is done so as to increase the active actuation area. Moreover, since there is a strong radial flow directing the fluid to the center (as described above), the sectors need not be placed in the center to cover the center mixing. The fluid forces generated at the tip or vertex of the sectors are sufficient to push the liquid to the center.

This section describes a programmable RF switching network for the packaged FASA micromixer. Different switching schemes are introduced for the Overlap, 4-sector and the 6-sector micromixer.

Figure 3:
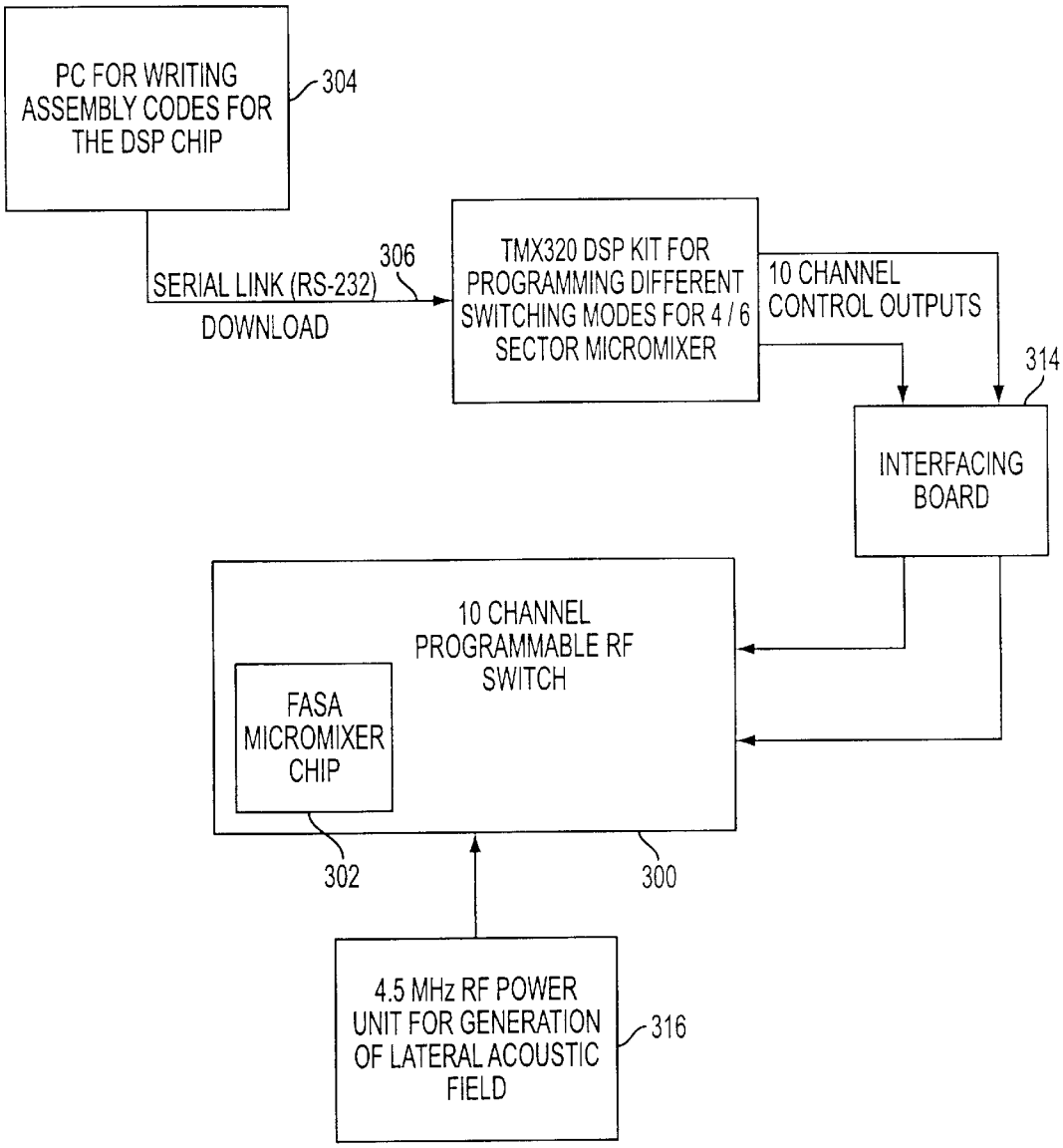
FIG. 3 illustrates a block diagram of the DSP controller for the FASA micro-mixer.

To accomplish programmable micromixing in the FASA micromixer, there has to be a switching network, which can govern the power and operating sequence of the FASA cells or sectors, as shown in FIG. 3. This is achieved by using a semiconductor analog switch 300, which is capable of switching RF power to the FASA micromixer 302. These analog switches can be driven with the DSP control signals coming from the DSP chip. Different switching schemes are coded in the assembly language of the DSP chip. This is compiled in the PC. 304 and the machine code is downloaded into the DSP chip using an RS-232 serial link 306. Then this sequence is passed on through an interface 314 to the analog switch 300, which turns on/off the RF power from source 316 to be delivered to the mixer. FIG. 3 shows the block diagram of the DSP controller.

The switching schemes with the RF switching network have to take into account the electromagnetic interference and the cancelling effects among the sectors that would happen if the sectors operate at the same time. The following three operating schemes for the 4-sector and the 6-sector micromixers have been developed:

1) Spin mixing

2) Agitation mixing

3) Random mixing

The spin mixing is for high fluid velocities and less turbulence. In this, the sectors in the center are sequenced in a clock or counter-clock direction. At the same time, the sectors in the corner are also sequenced in clock or counter-clock direction with the same or different spinning frequency. A total of at least four sets of spin mixing are possible which are:

Center (clock) & Comer (clock)

Center (clock) & Corner (counter-clock)

Center (counter-clock) & Corner (clock)

Center (counter-clock) & Comer (counter-clock)

The agitation mixing is for high turbulence and low fluid velocities. In this, the sectors in the corner and center are alternately sequenced in clock direction for the first cycle and counter-clock direction for the second cycle.

The random mixing is for average turbulence and fluid velocities and for more randomness in the fluid sample. In this, the sectors are switched in a random fashion according to a random control signal generated by the DSP chip.

Figure 11:
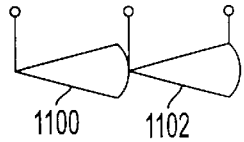
FIG. 11 illustrates a linear series of FASA transducers for fluid transport.

Other features and advantages of this invention may occur to a person of skill in the art who studies this invention disclosure. For example, a linear series of separately energized FASA devices 1100, 1102, schematically shown in FIG. 11, could be used to transport fluid. Therefore, the scope of the invention is to be limited only by the following claims.

What is claimed is:

1. An acoustic wave micromixer utilizing a fresnel annular sector actuator (FASA) having an electrode pattern designed to have a high lateral acoustic potential across a focal plane of the actuator, and a source of RF power applied between electrodes with frequencies corresponding to the thickness mode resonance of a piezoelectrode substrate, generating acoustic waves able to create vertical and/or lateral particle displacement.

2. A micromixer as claimed in claim 1 wherein the electrodes comprise segmented top and bottom electrodes such that the overlap area under actuation at any give time is about 90°.

3. A micromixer as claimed in claim 1 where the electrode pattern includes four FASA devices in a center of the micromixer, and one or more FASA devices in corners of the mixer to diminish dead zones.

4. A micromixer as claimed in claim 3 including one or more additional FASA devices in the central region of the micromixer.

5. A micromixer as claimed in claim 4 including 6 sectors on the upper and lower surfaces of the substrate and placed around the center of the substrate with their vertexes pointed at the center.

6. A micromixer as claimed in claim 5 wherein the six or more sectors are sequenced in a clock or counter-clock direction.

7. A micromixer as claimed in claim 5 further comprising a plurality of outer sectors each having a vertex pointed away from the center of the sector array.

8. A micromixer as claimed in claim 7 further comprising means for sequencing the sectors in the center in a clock or counter-clock direction and the outer sectors are also sequenced in a clock or counter-clock direction.

9. A micromixer as claimed in claim 8 wherein the sectors in the comer are sequenced at a different frequency than the sectors in the center of the mixer.

10. A micromixer as claimed in claim 3 including four isolated sectors spaced around a center of the substrate with the vertex of each sector pointed at the center and further comprising, on a generally rectangular substrate, a sector having a vertex pointed at each corner of the substrate and capable of selective actuation so that the corner sectors substantially eliminate dead zone region in the overall mixing device.

11. A micromixer as claimed in claim 10 wherein the sectors in the center are sequenced in a clock or counter-clock direction.

12. A micromixer as claimed in claim 10 wherein the sectors in the center are sequenced in a clock or counter-clock direction, and the sectors in the corner are also sequenced in a clock or counter-clock direction.

13. A micromixer as claimed in claim 12 wherein the sectors in the corner are sequenced at a different frequency than the sectors in the center of the mixer.

14. A micromixer as claimed in claim 1 wherein the FASA comprises a piezoelectric film sandwiched by upper and lower electrodes.

15. A micromixer as claimed in claim 14 wherein the FASA electrodes comprise a plurality of concentric conductive traces on the upper and lower surfaces of the substrate.

16. A micromixer as claimed in claim 15 wherein the conductive traces are substantially equally spaced.

17. A micromixer as claimed in claim 16 wherein the conductive traces are substantially equally spaced across the upper and lower surfaces of the substrate.

18. A micromixer as claimed in claim 1 wherein the micromixer comprises two half circles on each of the top and bottom of the substrate which can be separately energized, the half circle electrode patterns being offset from each other by 90° so that by appropriate energization of the overlapping half circles on the top and bottom, respectively, an approximately 90° segment can be energized at one time.

19. An acoustic mixer as claimed in claim 18 wherein means are provided for consecutive sequencing of the overlapping sections of the mixer so that a rotational cycle is formed.

20. An acoustic wave micromixer using a plurality of fresnel annular sector actuators (FASA) each having a vertex and an outer edge portion of a sector, wherein each FASA has a vertex and an outer region, and wherein the FASAs are arranged with one or more of the vertexes pointed at on outer region of an adjacent sector.

* * * * *